109-82 SR
3/8/88 XR 4,729,326

United States Patent [19]

Richter

[11] Patent Number: 4,729,326

[45] **Date of Patent: * Mar. 8, 1988**

[54] WALK-IN SHELTER

[75] Inventor: Klaus Richter, Berlin, Fed. Rep. of Germany

[73] Assignee: Allgemeiner Brandschutz G.u.M. Breivogel GmbH, Mainz, Fed. Rep. of Germany

[ * ] Notice: The portion of the term of this patent subsequent to Dec. 16, 2003 has been disclaimed.

[21] Appl. No.: 920,529

[22] Filed: Oct. 17, 1986

Related U.S. Application Data

[63] Continuation of Ser. No. 759,470, Jul. 26, 1985, Pat. No. 4,628,826.

[30] Foreign Application Priority Data

Jul. 27, 1984 [CH] Switzerland ..... 3615/84

[51] Int. Cl.[4] ..... E05G 3/00

[52] U.S. Cl. ..... 109/1 S; 109/82; 52/267; 52/404

[58] Field of Search ..... 52/265, 267, 268, 269, 52/404, 408, 309.9, 79.1, 481; 109/1 S, 78, 80, 82, 83

[56] References Cited

U.S. PATENT DOCUMENTS

| | | | |
|---|---|---|---|
| 2,189,126 | 2/1940 | Bonsall | 52/481 X |
| 2,582,144 | 1/1952 | Miles | 52/481 X |
| 2,699,669 | 1/1955 | Nelsson | 52/481 |
| 3,535,842 | 10/1970 | Karn | 52/481 X |
| 3,561,183 | 2/1971 | Keener | 52/269 X |
| 4,221,093 | 9/1980 | Crookston | 52/269 |
| 4,306,396 | 12/1981 | Fotti | 52/268 X |
| 4,381,716 | 5/1983 | Hastings et al. | 109/82 X |
| 4,470,357 | 9/1984 | Sanzaro | 109/82 X |
| 4,501,101 | 2/1985 | Davis | 52/268 X |
| 4,628,826 | 12/1986 | Richter | 109/1 S |

*Primary Examiner*—Carl D. Friedman
*Attorney, Agent, or Firm*—Basile and Hanlon

[57] ABSTRACT

A walk-in shelter providing protection against undesired heat, radiation, gas and water action, as well as mechanical stressing, particularly for data carriers is proposed, in which the walls comprise several different layers. The inner and outer layers are constructed as a closed metal envelope. Between the outer and inner layers is provided a metal supporting frame and between the outer layer, supporting frame and inner layer are provided insulating layers with high thermal insulation and mechanical strength. All the layers are set up independently of one another, are self-supporting and not mechanically interconnected.

19 Claims, 3 Drawing Figures

WALK-IN SHELTER

This application is a continuation of application Ser. No. 06/759,470, filed July 26, 1985 now U.S. Pat. No. 4,628,826.

BACKGROUND OF THE INVENTION

I. Field of the Invention

The invention relates to a walk-in or a man-size protective house or shelter, which gives protection against undesired heat, radiation, gas and water action and is resistant to other mechanical stresses, being particularly intended for data carriers.

II. Description of the Prior Art

There has long been a need to store important documents, data carriers, chemicals or the like in such a way that they will not be destroyed during undesired action from the outside, e.g. the increased heat action during a fire or radiation action. The articles to be stored are normally placed in self-contained, sealed strong rooms or safes, where they are safe from access from the outside, but generally no precautions are taken for the case of fires.

SUMMARY OF THE INVENTION

The present invention comprises a walk-in shelter for storing documents, particularly data carriers or chemicals and the like, in which the articles are reliably and non-destructively protected against undesired heat action, e.g. during a fire, radiation, gas or water action. The shelter has a simple construction, whose sides can easily be adapted to the required circumstances.

The shelter has walls that comprise (from outside to inside) a closed external metal envelope, one or more insulating layers, a supporting frame, one or more further insulating layers and an inner closed metal envelope. The protection afforded is particularly reliable against fire and radiation effects, and this protection is further increased in that the individual layers are set up independently of one another, are self-supporting and not mechanically interconnected. Thus, each part fulfills the function associated with it, without the help of the other parts. The inner and outer metal envelopes form a double Faraday's cage, so that a malicious or unintentional demagnetization of the magnetic data carriers constructed as magnetic tapes or floppy discs is not possible.

The modular construction makes it possible to obtain shelters or the like in random sizes, without it being necessary to modify the structure or the individual components.

Due to the fact that the heat storage capacity and/or the mass of the individual layers increases from the outside to the inside, the shelter is adapted to the thermal behavior of a fire, where the temperatures rise rapidly at the beginning and, after a certain time of approximately one hour, decrease in an approximately exponential manner. Heat transmission is delayed in the inward direction by the inventive construction and, when the temperatures drop in the outer area, heat transfer can once again take place from the inside to the outside. Thus, the inner area is not heated to such an extent that the documents or data carriers will be damaged or destroyed.

Through the displacement of the supports of the supporting frame and the intersections of the sheet metal elements, the hot zones are staggered, so that the heat is uniformly distributed and no heat bridges form.

The seals between the sheet metal elements of the inner metal envelope, together with the actual sheet metal elements, form a steam lock, so that the moisture, which is e.g. given off during a fire or exists as a result of partial pressure differences, does not pass into the inner area. As in the case of 100% humidity, the magnetic data carriers are demagnetized, this measure being indispensable.

The construction of the door with multiple folds or recesses ensures a reliable closure of the necessary opening in the shelter. As a result of the parallel moving out and the subsequent swinging, there is no need to revert back to the complicated two-door system.

BRIEF DESCRIPTION OF THE DRAWINGS

The invention is described in greater detail hereinafter relative to non-limitative embodiments and the attached drawings, wherein.

DESCRIPTION OF THE PREFERRED EMBODIMENT

Figure 1:
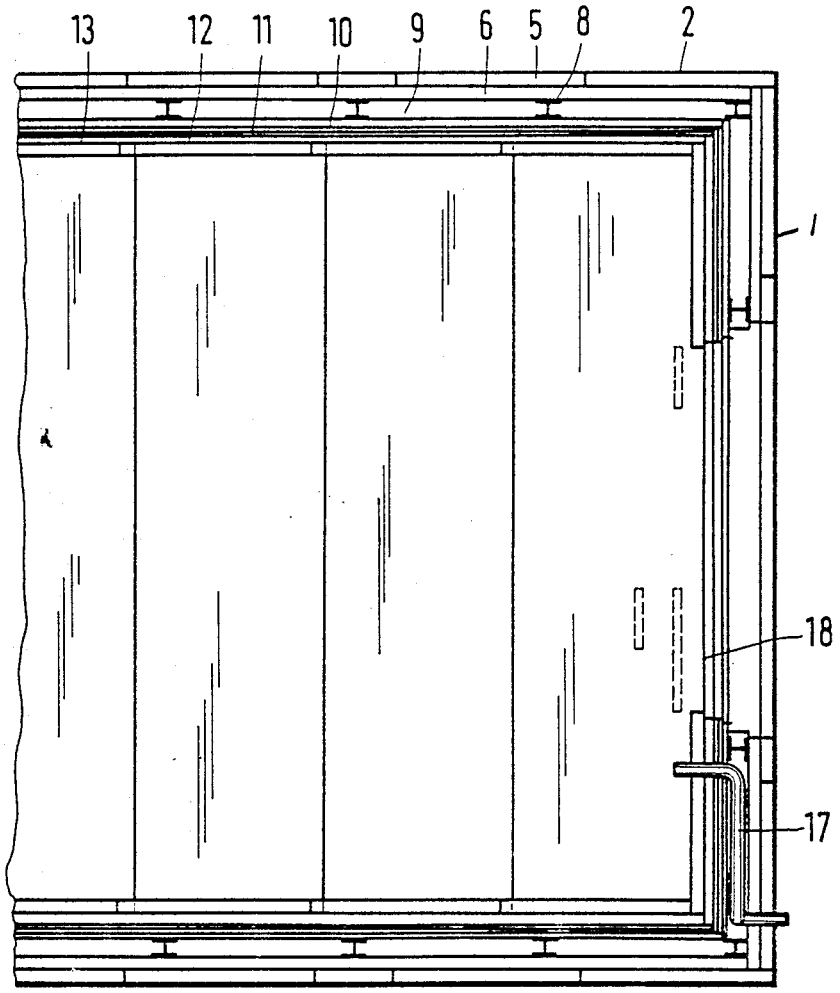
FIG. 1 is a section through the shelter parallel to the top or bottom.
Figure 2:
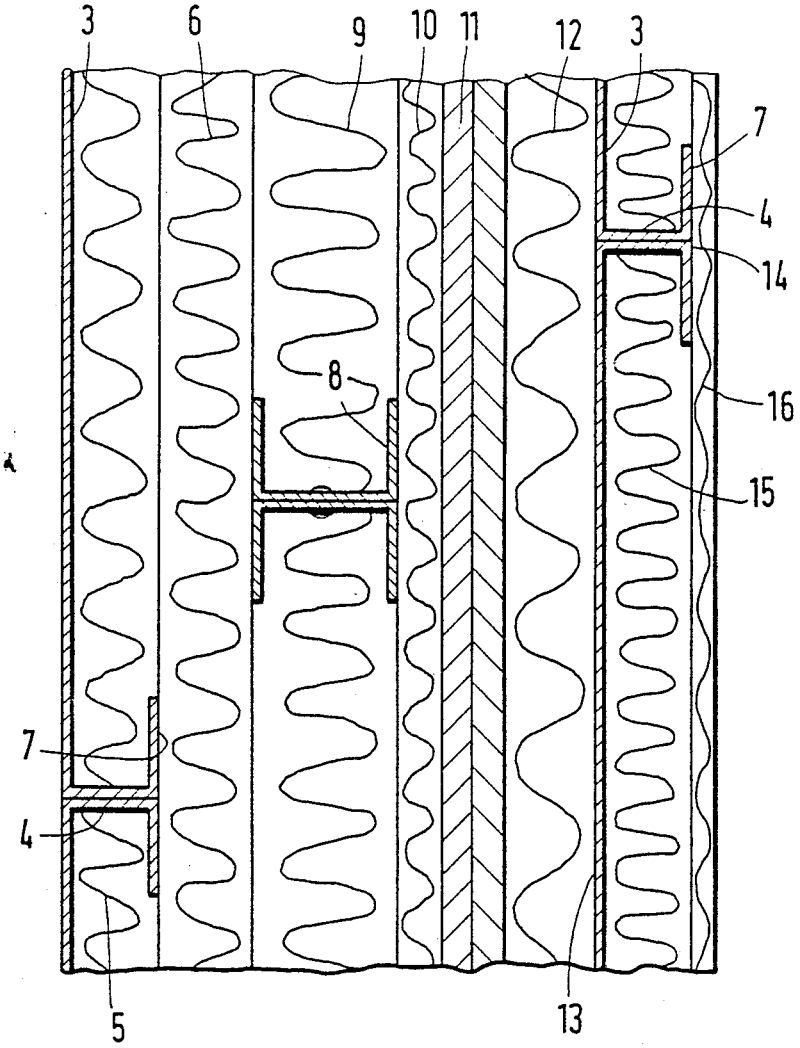
FIG. 2 is a larger-scale sectional representation through one of the walls of the shelter.

As can be seen from FIGS. 1 and 2, the protective house or shelter 1 comprises several layers, the construction being the same for the walls, the top and the bottom. The outer layer of shelter 1 comprises a continuous metal envelope 2, which is formed by individual interconnected sheet metal elements 3 (FIG. 2). The edge regions of the latter are twice bent at right angles, so that in said edge areas a cross-sectionally U-shaped profile is formed (FIG. 2). At the angles 4 bent at right angles to the outer envelope, sheet metal elements 3 are joined together by screws, rivets, welding or the like (not shown). Into each of the sheet metal elements 3 is inserted an insulating layer 5 with good thermal insulation and mechanical strength, e.g. of rock wool, which is held by the U-profile of the edge area of sheet metal elements 3. To insulating layer 5 held in elements 3 is connected a further insulating layer 6 made from the same or a similar material to layer 5, the mechanical strength of the thermal insulating material having to be adequate to ensure that insulating layer 6 engaging on the edge area 7 of sheet metal elements 3 bent parallel to the outer face of elements 3 is able to support itself. To insulating layer 6 is connected a supporting frame constituted by beams 8, which have a U-profile and are joined together by welding, rivets or screws, so that an H-profile is obtained. It is obviously also possible to use beams with different profiles. Like the other layers 2, 5 and 6, the supporting frame 8 is self-supporting and is not mechanically connected to insulating layer 6 or the sheet metal elements 3. Thermal insulation plates 9 are placed in the U-profiles of beams 8. Towards the inner area is provided a further insulating layer 10, a layer of plaster boards 11 and yet another insulating layer 12. In the same way as the outer metal envelope 2, the shelter also has an inner metal envelope 13 made from sheet metal elements 3, but the continuous metal layer faces insulating layer 12, while the bent regions are directed towards the inner area. Between the intersections of the sheet metal elements, i.e. between the angular areas bent at right angles, are provided seals 14. As in the case of the outer sheet metal elements, the bent areas 4, 7 embrace the thermal insulation plates 15. As shown in FIG. 2, the inner area can contain a covering 16 made from wood, plaster boards or the like.

The individual layers of the sandwich-like structure of the walls are not interconnected and are alone, so that heat transfer cannot take place via any connecting members. The thermal insulation material used for layers 5, 6, 9, 10, 12 and 15 has a high thermal insulation and, particularly in the outer region, a low storage capacity. According to a preferred embodiment, the heat storage capacity of all the layers increases from the outside to the inside. Thus, the mass increases from the outside to the inside, e.g. the thickness of the inner metal envelope 13 formed from the sheet metal elements is greater than that of the outer metal envelope 2. The intersections between the sheet metal elements of the inner and outer envelopes 13, 2 are arranged in displaced manner with respect to the supporting frame beams 8, so that the hot zones are also displaced. As a result of the individual sheet metal elements 3, a modular construction is obtained, so that the size of shelter 1 can be modified by the provision of a larger or smaller number of elements 3 and correspondingly frame beams 8.

As can be seen in FIG. 1, there is a supply pipe 17 for a $CO_2$, halogen or similar extinguishing system, which projects through the individual layers. The supply pipe is deflected on a number of occasions and is surrounded in outer layers 2, 5, 6 by a sleeve, which is enveloped with fire protection material. In the case of a fire, the fire protection material foams and forms a reliable seal between the outer metal envelope 2 and insulating layers 5, 6.

Figure 3:
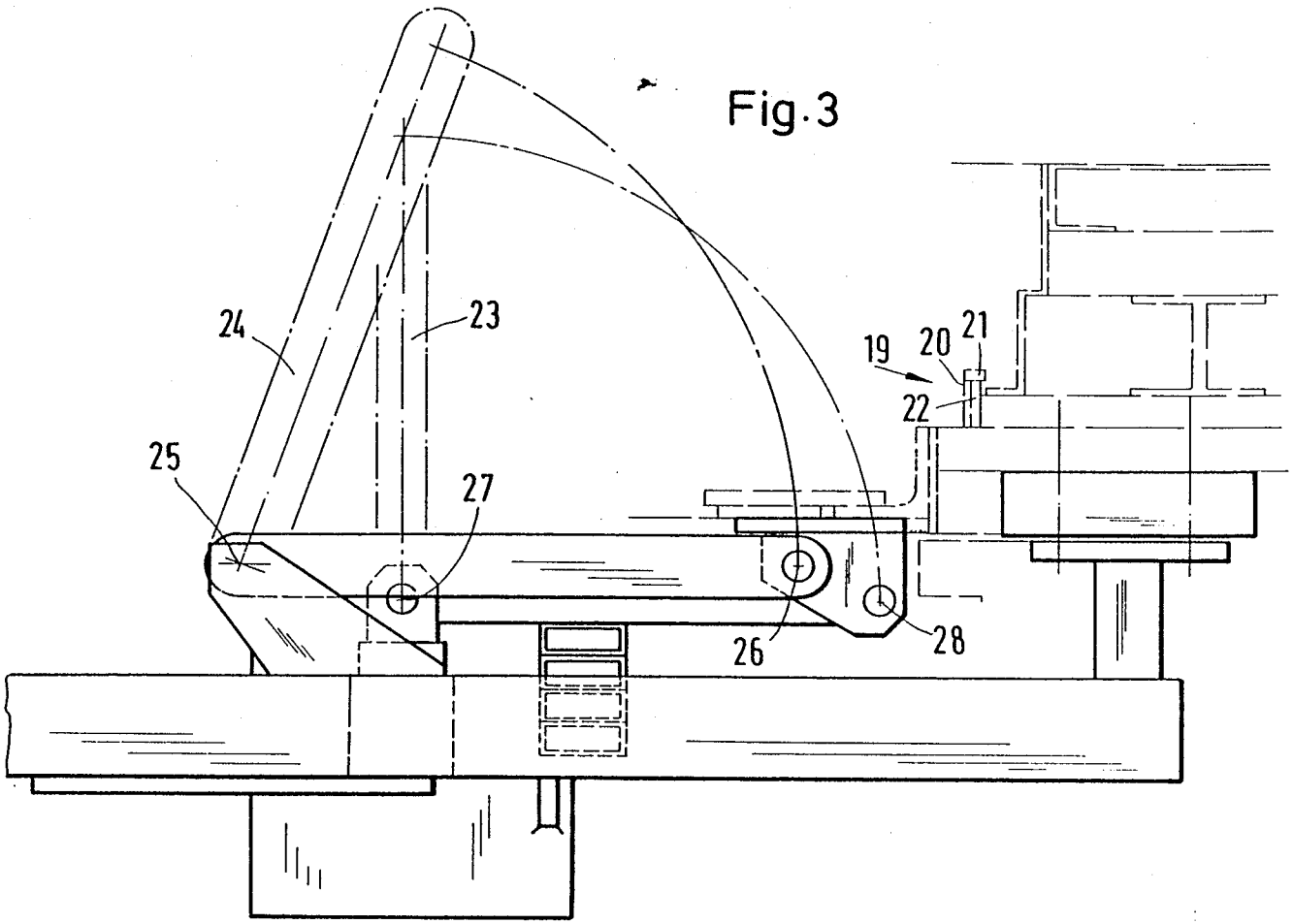
FIG. 3 is a view of the door with levers controlling the moving out and swinging.

It is possible to enter the shelter through an opening closable by a door 18, which is shown in greater detail in FIG. 3. Corresponding to the inner and outer metal sleeves 2, 13, it comprises sheet metal elements 3 with inserted thermal insulation material, while between the inner and outer wall layers and consequently the door are provided interconnected fire protection plates. For better sealing purposes, the door is folded or recessed on a number of occasions, whereby at fold point 19 the construction is such that a cavity 20 is formed, in which is placed a seal 21. A steel lip 22 presses door 18 against seal 21 in the closed state. The door fitting for opening and closing door 18 is arranged in the inner area and has, as can be seen in FIG. 3, a swinging lever 23 and a steering lever 24. The latter prevents the initial swinging out of the door and ensures a parallel moving out until a swinging of door 18 is possible. This cannot take place from the outset, due to the thickness of the door and its mounting. As can be seen from FIG. 3, levers 23 and 24 describe different movement radii. The lever position with the door 18 completely open is shown in dot-dash form. Swinging lever 23 performs a 90° swing movement, while the steering lever 24 describes a smaller angle of swing. Steering lever 24 is shorter than swinging lever 23 and the pivot points of lever 24 are upstream of those of the swinging lever in the direction of movement. In addition, the pivot points of levers 23 and 24 are laterally displaced. Further openings can be provided in shelter 1, while being provided with closing members corresponding to door 18.

I claim:

1. A walk-in shelter for protection against undesired heat, radiation, gas and water action and against mechanical stressing, particularly for data carriers, comprising walls including several different layers, outer and inner layers (2, 13) constructed as a closed metal envelope, a metallic supporting frame (8) provided between and spaced from the outer and inner layers (2, 13), insulating layers (6, 10, 12) between outer layer (2), supporting frame (8) and inner layer (13), with high thermal insulation and mechanical strength, and the outer and inner layers (2, 13), supporting frame (8) and insulating layers (6, 10, 12), set up independently of one another, are self-supporting and not mechanically interconnected.

2. The shelter according to claim 1, wherein the metal envelope (2, 13) comprises bent sheet metal elements (3).

3. The shelter according to claim 2, further comprising the sheet metal elements (3) having edge regions (4, 7) bent at right angles, the edge regions of the particular sheet metal elements (3) being interconnected.

4. The shelter according to claim 3, further comprising the edge regions (4, 7) bent twice at right angles.

5. The shelter according to claim 2, further comprising the sheet metal elements (3) of the metal envelope (13) forming the inner layer sealed at their intersections with a seal (14).

6. The shelter according to claim 1, wherein the supporting frame comprises parallel beams (8).

7. A walk-in shelter for protection against undesired heat, radiation, gas and water action and against mechanical stressing particularly for data carriers comprising an enveloped enclosure defined by multi-layer walls, each wall including:

an inner metal layer and an outer metal layer constructed as a closed metal envelope;

a plurality of self-supporting parallel metal beams located between the inner and outer metal layers, the parallel metal beams positioned in spaced relationship to each other and to both the inner and outer metal layers;

a first insulating layer located between the outer metal layer and the parallel beams being self-supporting and independent of the outer layer and the beams having high thermal insulating characteristics, the first insulating layer preventing contact between the outer layer and the parallel beams;

a second insulating layer located between the inner metal layer and the parallel beams being self-supporting and independent of the outer layer and the beams having high thermal insulating characteristics, the second insulating layer preventing contact between the inner metal layer and the parallel beams;

a third insulating layer located between the first and second insulating layer, said first, second and third insulating layers being self-supporting and independent of one another.

8. The shelter according to claim 7 further comprising a plaster board layer located between the second insulating layer and the third insulating layer.

9. The shelter according to claim 7, wherein the layer structure of the walls from the outside to the inside comprises:

(a) bent sheet metal elements (3) with high strength insulating material (5) placed in the bent regions, (b) insulating layer (6) with high thermal insulation and mechanical strength, p1 (c) supporting frame with beams (8), high strength insulating material (9) placed in the profile between the individual beams (8), (d) insulating layer (10) with a high thermal insulation and mechanical strength, (e) plaster board layer (13), (f) insulating layer with high thermal insulation and mechanical strength, (g) bent sheet material elements (3) with seals (14) provided between intersections of each element (3), the bent regions directed toward the interior and filled with high strength insulating material (15), and (h) wood, plaster board or similar covering (16).

10. The shelter according to claim 9, wherein the layers have increasing heat storage capacity from the outside to the inside.

11. The shelter according to claim 9, wherein the layers have increasing mass from the outside to the inside.

12. The shelter according to claim 9, further comprising the shelter having a modular construction with sizes of the modules determined by the sheet metal elements (3).

13. The shelter according to claim 9, wherein the beams (8) of the supporting frame and the intersections of the sheet metal elements (3) are arranged so as to be displaced relative to one another.

14. The shelter according to claim 9, further comprising a supply pipe (17) for an extinguishing system in the walls and deflected on a number of occasions from the outside to the inside, the supply pipe (17) having a sleeve in the outer layers (2, 5, 6) enveloped by fire protection material which foams in the case of a fire.

15. The shelter according to claim 9, further comprising a multiply folded door (18) formed from high density fire protection plates received in a frame connected to the inner metal envelope (13), such that the door (18) firstly moves out parallel and then swings.

16. The shelter according to claim 15, further comprising a swinging lever (23) and a steering lever (24), the steering lever (24) preventing the door from swinging out in the first 10 degrees to 15 degrees of the swinging movement of the swinging lever (23).

17. The shelter according to claim 16, further comprising pivot points (25, 26) of the steering lever (24) positioned upstream of the pivot points (27, 28) of swinging lever (23) in the direction of movement.

18. The shelter according to claim 16, wherein the steering lever (24) is longer than the swinging lever (23).

19. The shelter according to claim 15, wherein the door (18) has at least one 360 degree fold (19).

* * * * *

UNITED STATES PATENT AND TRADEMARK OFFICE

CERTIFICATE OF CORRECTION

PATENT NO. : 4,729,326

DATED : March 8, 1988

INVENTOR(S) : Klaus Richter

It is certified that error appears in the above-identified patent and that said Letters Patent is hereby corrected as shown below:

On the Title Page, delete the Assignee Name "Allgemeiner Brandschutz G.u.M. Breivogel GmbH" and insert the Assignee Name --ABS Allgemeiner Brandschutz G.u.M. Breivogel GmbH--.

Signed and Sealed this

Second Day of August, 1988

*Attest:*

*Attesting Officer*

DONALD J. QUIGG

*Commissioner of Patents and Trademarks*